US007216670B1

(12) United States Patent
Kozlowski

(10) Patent No.: US 7,216,670 B1
(45) Date of Patent: May 15, 2007

(54) DRAIN APPARATUS WITH LIQUID TRAP AND LIQUID LEVEL INDICATOR

(75) Inventor: David Kozlowski, Napa, CA (US)

(73) Assignee: NSERTASEAL Corporation, Napa, CA (US)

( * ) Notice: Subject to any disclaimer, the term of this patent is extended or adjusted under 35 U.S.C. 154(b) by 534 days.

(21) Appl. No.: 10/868,072

(22) Filed: Jun. 15, 2004

(51) Int. Cl.
*F16K 37/00* (2006.01)
*E03C 1/284* (2006.01)
*E03F 5/04* (2006.01)

(52) U.S. Cl. ..... 137/558; 137/247.49; 137/362; 4/679; 404/4; 73/322

(58) Field of Classification Search ..... 137/247.41, 137/247.45, 247.49, 362, 558; 4/679; 73/322; 116/228; 404/4
See application file for complete search history.

(56) References Cited

U.S. PATENT DOCUMENTS 588,605 A * 8/1897 Robinson et al. ..... 73/322
1,586,201 A * 5/1926 Kauffmann ..... 73/713
1,778,840 A * 10/1930 Wale ..... 73/322
1,978,185 A * 10/1934 Booss ..... 73/444
1,999,272 A * 4/1935 Austin ..... 116/227
2,630,875 A * 3/1953 Sachs ..... 137/247.15
2,985,187 A * 5/1961 Hamilton ..... 137/558
3,832,970 A * 9/1974 Nilsson ..... 116/222
5,192,156 A 3/1993 Webb
6,049,922 A * 4/2000 Gleason ..... 4/679
6,786,091 B1 * 9/2004 Aleali ..... 73/322
2001/0050257 A1 * 12/2001 Houck et al. ..... 210/747

* cited by examiner

*Primary Examiner*—John Rivell
(74) *Attorney, Agent, or Firm*—Thomas R. Lampe

(57) ABSTRACT

A buoyant liquid level indicator device is positioned within liquid drain apparatus having a trough accommodating liquid to form a liquid seal to prevent passage of gas through the liquid drain apparatus. The indicator device will float and be exposed to an outside observer only when a liquid seal is formed by the liquid drain apparatus.

15 Claims, 7 Drawing Sheets

DRAIN APPARATUS WITH LIQUID TRAP AND LIQUID LEVEL INDICATOR

TECHNICAL FIELD

This invention relates to apparatus for draining liquid from a surface. The apparatus is so constructed as to form a liquid barrier preventing gases from passing upwardly therethrough. An indicator indicates when a liquid barrier or seal is formed thereby.

BACKGROUND OF THE INVENTION

U.S. Pat. No. 5,192,156, issued Mar. 9, 1993, discloses apparatus for draining liquid from a surface into a sewer through a passageway extending between the surface and the sewer and for forming a liquid barrier between the sewer and the surface to prevent the flow of gases from a sewer to a surface. The apparatus incorporates structure which facilitates the flow of drainage liquid therethrough.

While the apparatus of U.S. Pat. No. 5,192,156 is highly effective, direct close visual inspection by an individual is required to determine whether or not sufficient liquid is in place in the apparatus to form a gas barrier. To determine whether such is the case, an inspector has to actually observe the interior of a conduit of the apparatus, either through holes in a grating at the top of the conduit or by removing the grating and directly viewing the conduit interior.

DISCLOSURE OF INVENTION

The present invention relates to an inexpensive, relatively simple approach enabling an observer to quickly and readily determine whether or not a liquid trap is formed in a liquid drain apparatus. This approach allows such determination to be made without close inspection having to be made.

The present invention encompasses a structural combination including liquid drain apparatus for draining liquid from a surface, the liquid drain apparatus including a conduit having an upper open end for receiving the liquid and a lower end.

A bottom wall partially extends across the lower end and defines an opening at the lower end for discharging liquid from the conduit. A partition having an upper partition end extends upwardly from the bottom wall and is cooperable with the conduit and the bottom wall to form an open topped trough within the conduit.

A baffle is located within the conduit and has a baffle lower distal end located in the trough above the bottom wall. The conduit, the baffle and the partition are operable to form a liquid seal to prevent gas from passing through the conduit when liquid in the trough is of sufficient depth to engage the baffle lower distal end.

A buoyant liquid level indicator device is disposed within the conduit and has an upper indicator device end and a lower indicator device end. The lower indicator device end is positioned in the trough. The buoyant liquid level indicator device is operable to float and move upwardly within the conduit only when a liquid seal is formed by the liquid drain apparatus.

Other features, advantages and objects of the present invention will become apparent with reference to the following description and accompanying drawings.

MODES FOR CARRYING OUT THE INVENTION

Figure 3:
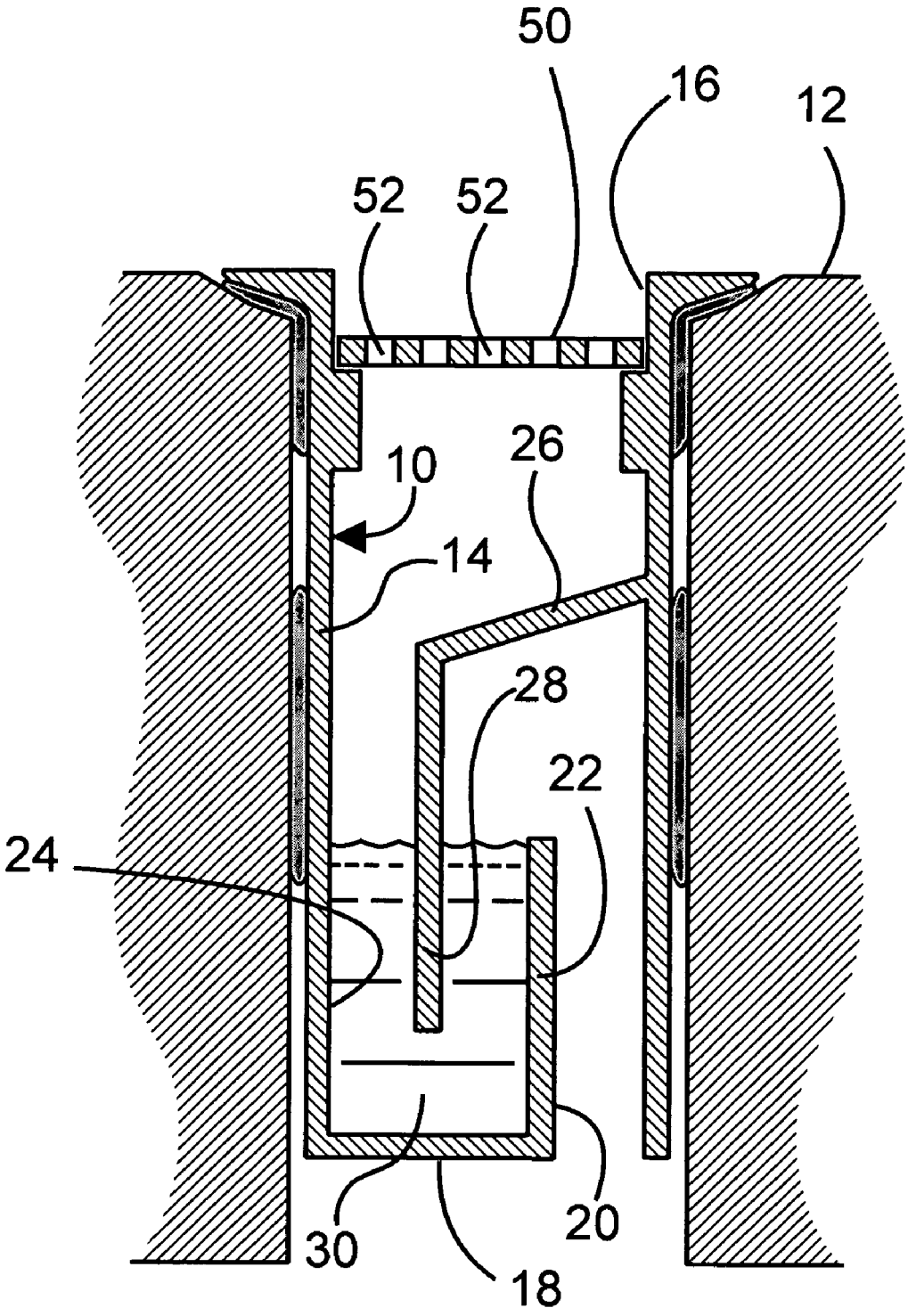
(PRIOR ART) FIG. 3
FIG. 3 is a vertical, cross-sectional view of prior art liquid drain apparatus in place in the ground.

Referring now to FIG. 3, liquid drain apparatus of known construction is illustrated. More particularly, the drain apparatus is of the type shown in U.S. Pat. No. 5,192,156, issued Mar. 9, 1993. The apparatus 10 is for the purpose of draining liquid from a surface 12 to a sewer or other location. The liquid drain apparatus includes a conduit 14 having an upper open end 16 for receiving the liquid and a lower end.

A bottom wall 18 partially extends across the lower end and defines an opening 20 at the lower end for discharging liquid from the conduit.

A partition 22 having an upper partition end extends upwardly from the bottom wall and is cooperable with the conduit and the bottom wall to form an open topped trough 24 within the conduit.

A baffle 26 is disposed within the conduit and has a baffle lower distal end 28 located in the trough 24 above the bottom wall.

In FIG. 3, liquid 30 is in the trough and the conduit, the baffle and the partition are operable to form a liquid seal to prevent gas from passing through the conduit when liquid in the trough is, as shown, of sufficient depth to engage the baffle lower distal end. Reference may be had to U.S. Pat. No. 5,192,156 for additional details concerning drain apparatus 10.

Referring now to FIGS. 1A, 1B, 4, 5 and 6, a form of buoyant liquid level indicator device constructed in accordance with the teachings of the present invention is illustrated and identified by reference numeral 40. Device 40 includes an upper indicator device end 44 which may suitably be a strip of stiff plastic and a lower indicator device end which may suitably be a piece of cork 46 secured by adhesive or other means to strip 44.

The buoyancy characteristics of the buoyant liquid level indicator device 40 are such that the device is operable to float and move upwardly within the conduit 14 when inserted therein only when a liquid seal is formed by the liquid drain apparatus. The liquid level indicator device 40 is elongated and the conduit 14 has a length longer than the length thereof.

Figure 4:
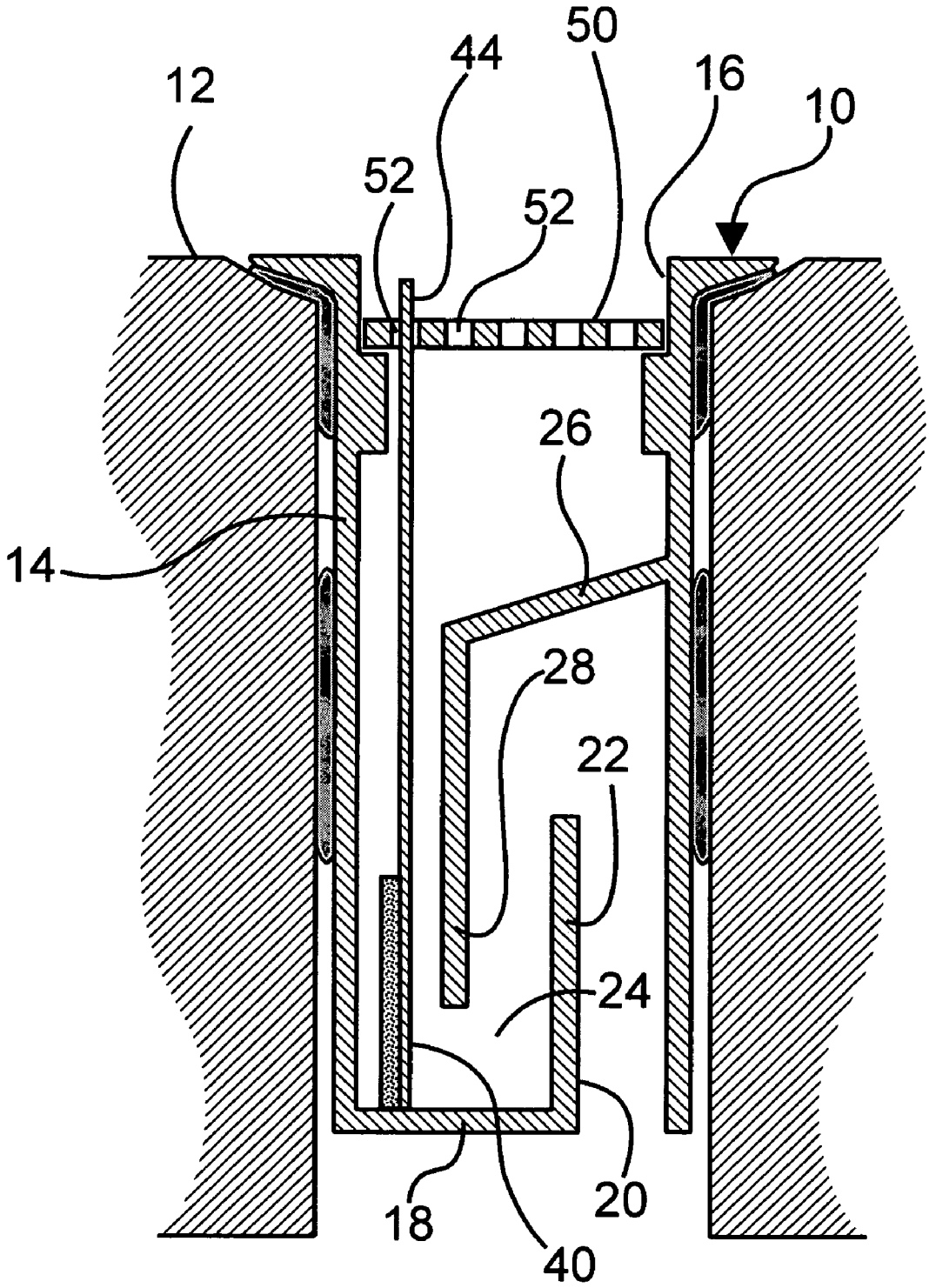
FIG. 4 is a view similar to FIG. 3, but illustrating a liquid level indicator device of the type shown in FIGS. 1A and 1B, the liquid drain apparatus trap being empty.
Figure 5:
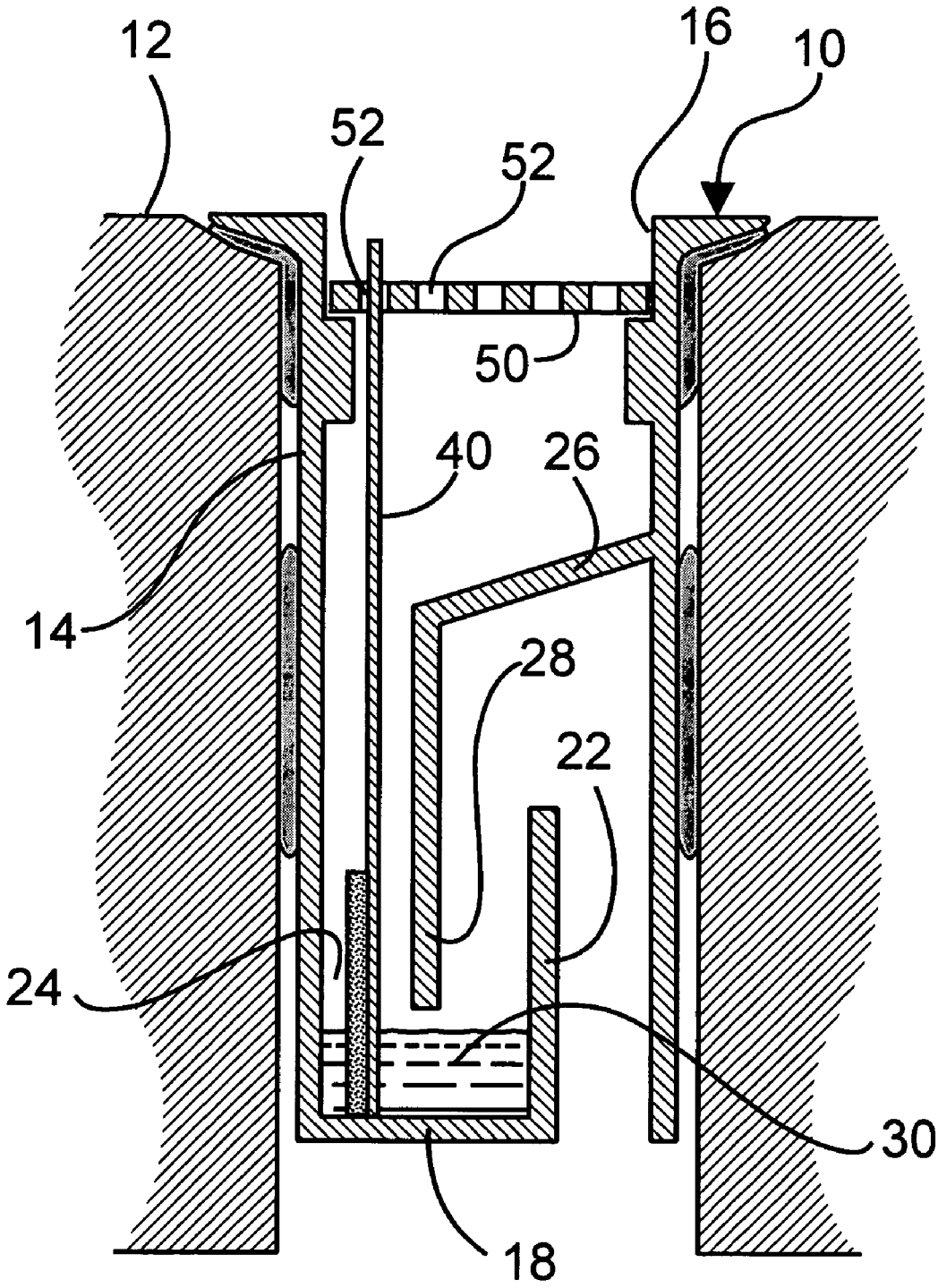
FIG. 5 is a view similar to FIG. 4, but illustrating the liquid trap partially filled with liquid.
Figure 6:
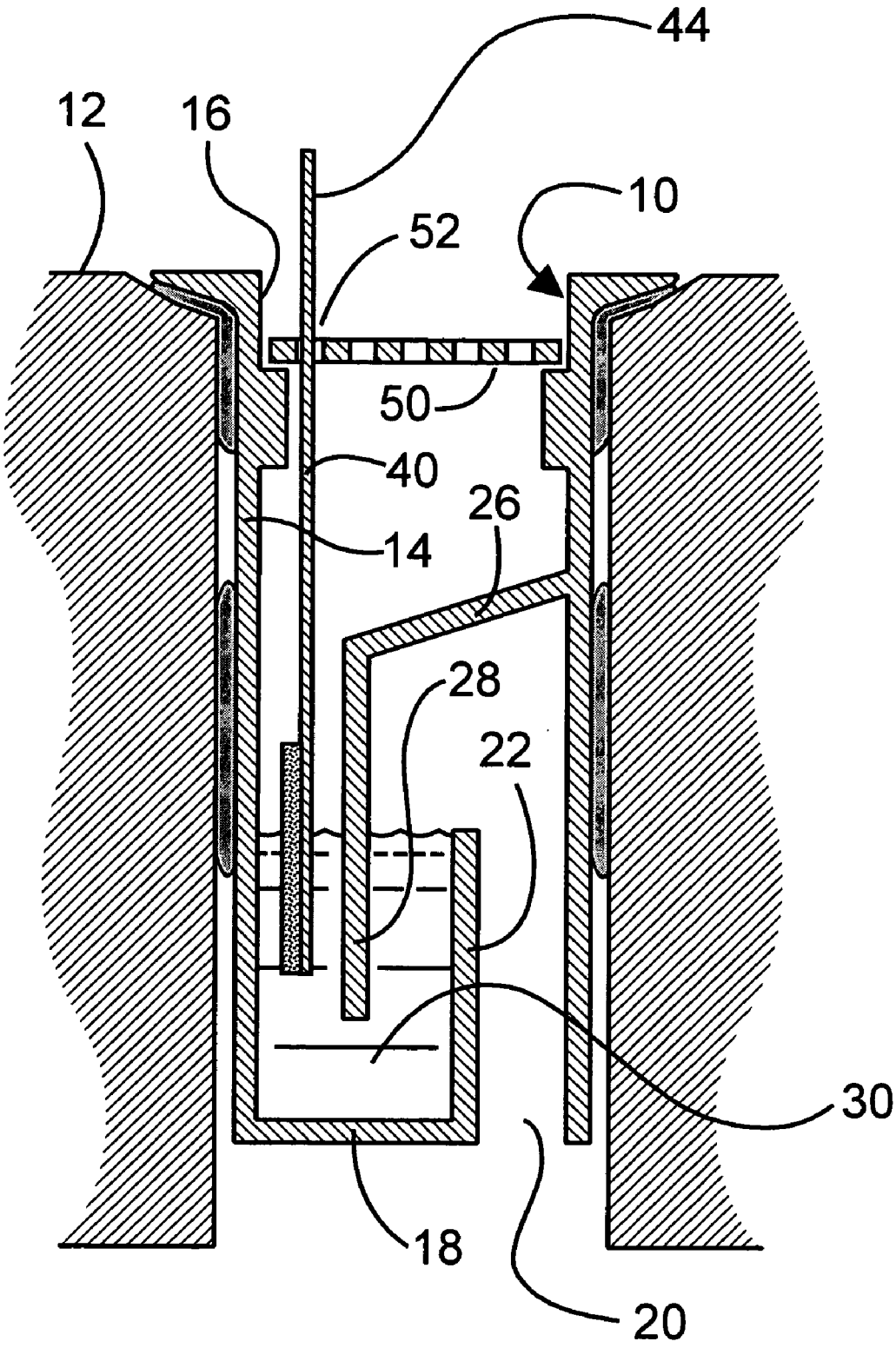
FIG. 6 is a view similar to FIGS. 4 and 5, but illustrating the liquid trap full and the buoyant liquid level indicator device floating and projecting from the top of the liquid drain apparatus to indicate that a liquid barrier preventing the escape of gas exists.

FIGS. 4, 5 and 6 show the liquid indicator device in place within conduit 14 of apparatus 10. The upper indicator device end 44 projects upwardly from the conduit upper open end when a liquid seal is formed by the liquid drain apparatus and is disposed below the conduit upper open end when a liquid seal is not formed by the liquid drain apparatus.

FIG. 4 shows the situation wherein the trough is empty, that is when the trough has no water therein and should be added. The liquid level indicator device engages bottom 18 and the top of the indicator device does not project above the apparatus 10.

FIG. 5 shows the situation wherein the trough is partially filled with water but the water level is not yet sufficiently high to engage baffle distal end 28 to form a liquid trap. The buoyancy of the liquid level indicator device is such that it remains engaged with bottom wall 18, again indicating to an observer that the trough should be filled.

After the level of liquid 30 in the trough is sufficiently high to form a liquid trap such as shown in FIG. 6, the liquid level indicator device will float upwardly and project beyond the upper end of the apparatus 10, where it can readily be observed, even from a distance.

In FIGS. 4, 5 and 6, a grating 50 having drain slots 52 therein is positioned on the conduit. The liquid level indicator device projects through one of the slots 52 and the grating thus functions as guide structure for maintaining the liquid level indicator device in a substantially vertical orientation in the conduit.

Figure 8:
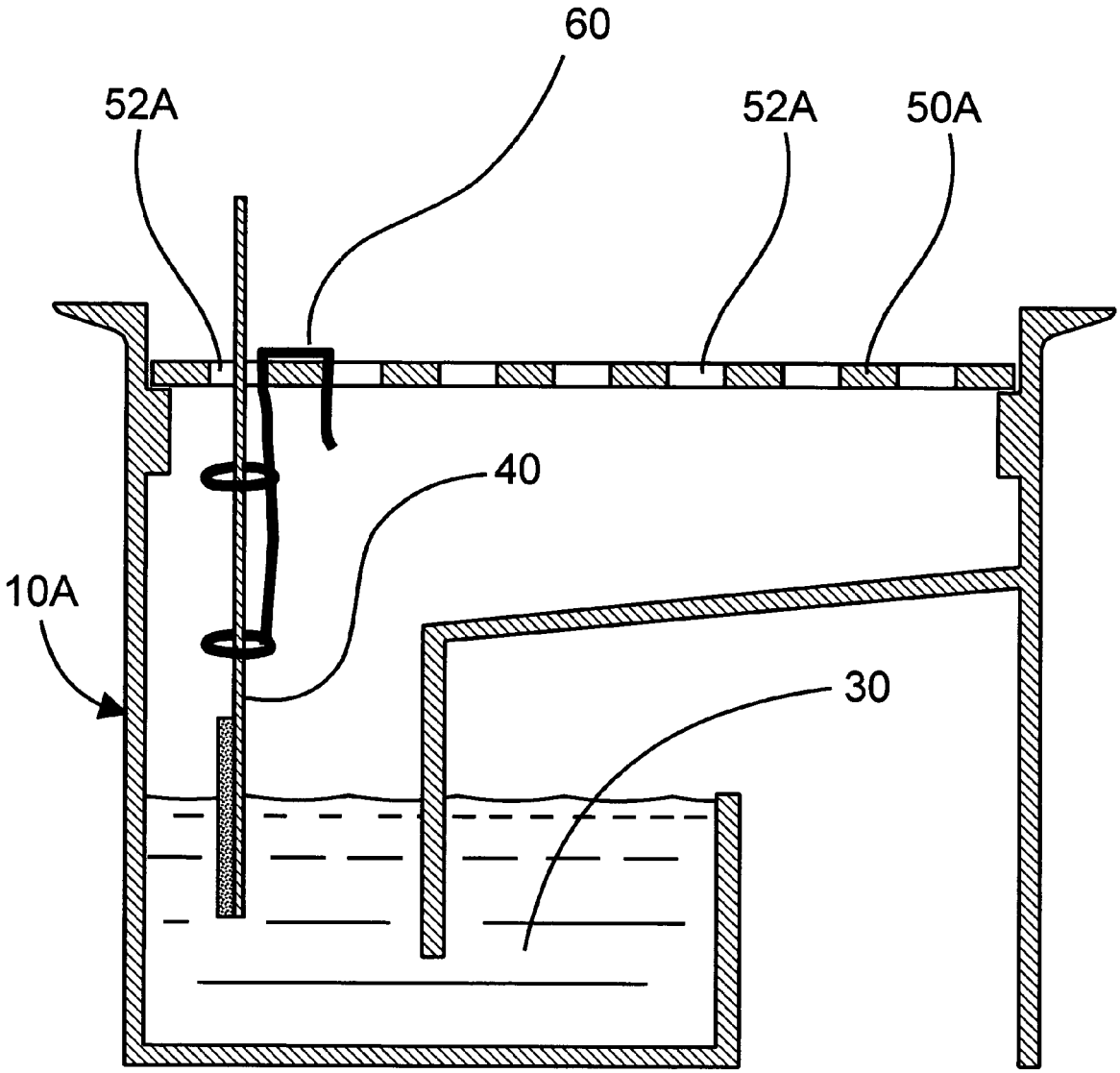
FIG. 8 illustrates another configuration of liquid drain apparatus and illustrating a holder extending into the liquid drain apparatus slidably receiving a floating liquid level indicator device.

FIG. 8 shows another form of liquid drain apparatus 10A which has a diameter larger than apparatus 10. In this arrangement, a holder 60 formed of wire or the like functions as a guide to maintain the liquid level indicator device in a substantially vertical orientation in the conduit while allowing the liquid level indicator device 40 to move up or down with the level of water 30.

Figures 1A, 1B, 2A, 2B, 2C:
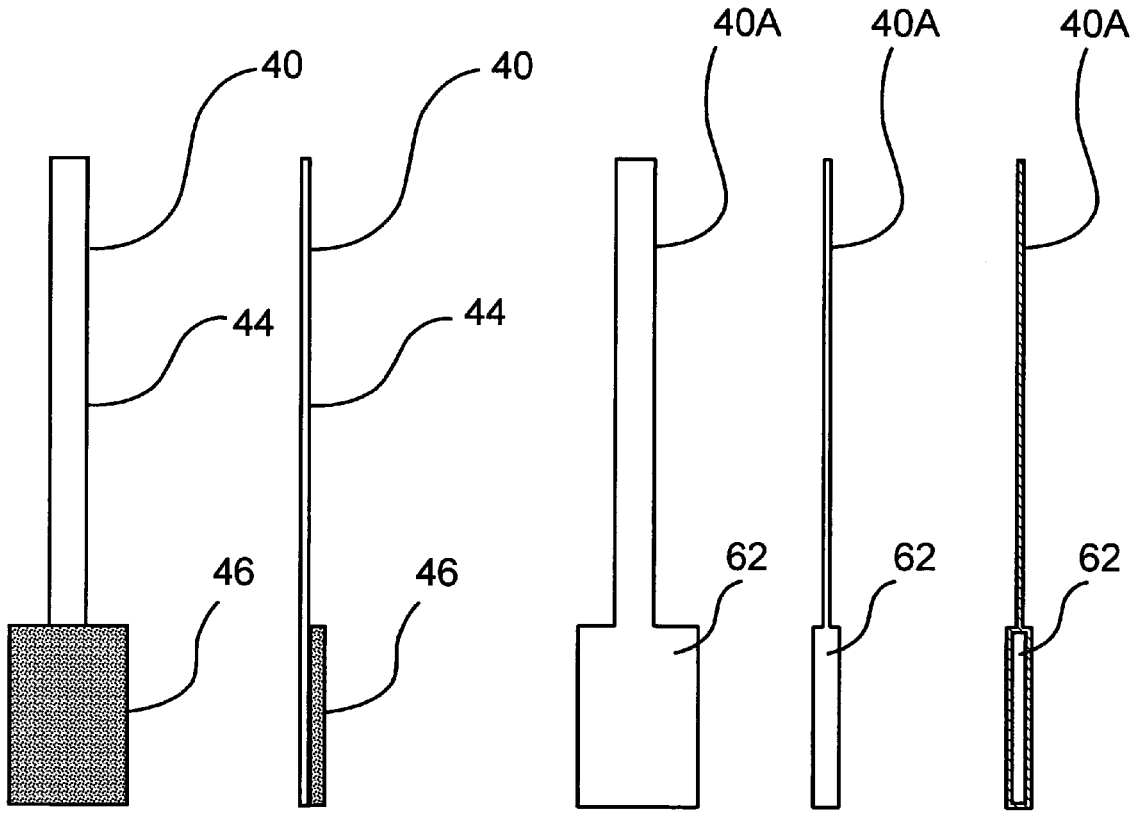
FIG. 1A is a front, elevational view of a first embodiment of buoyant liquid level indicator device constructed in accordance with the teachings of the present invention.
FIG. 1B is a side, elevational view of the indicator device of FIG. 1A.
FIG. 2A is a front, elevational view of a second embodiment of buoyant liquid level indicator device.
FIG. 2B is a side, elevational view of the liquid indicator device of FIG. 2A.
FIG. 2C is a cross-sectional, side, elevational view of the indicator device of FIG. 2A.

FIGS. 2A–2C show another form of liquid level indicator device 40A. As shown, liquid level indicator device 40A is of integral construction, being suitably formed for example from molded plastic material. The lower end of the indicator device is in the form of a closed, hollow flotation chamber 62.

Figure 7A:
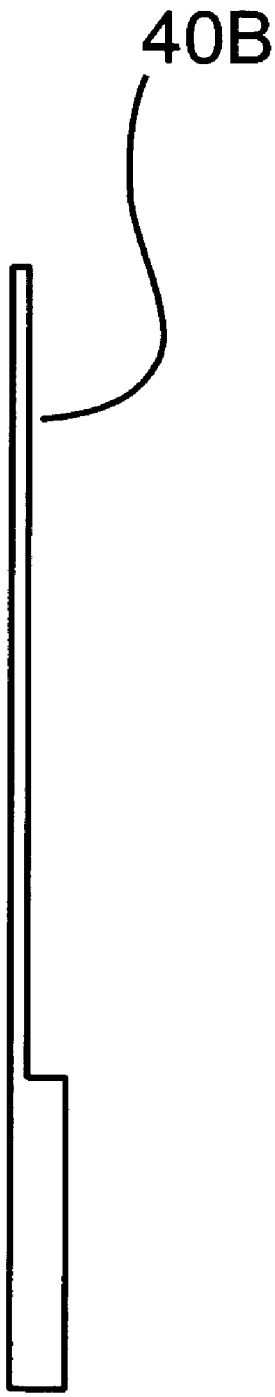
FIG. 7A is a side, elevational view of a third embodiment of liquid level indicator device.
Figure 7B:
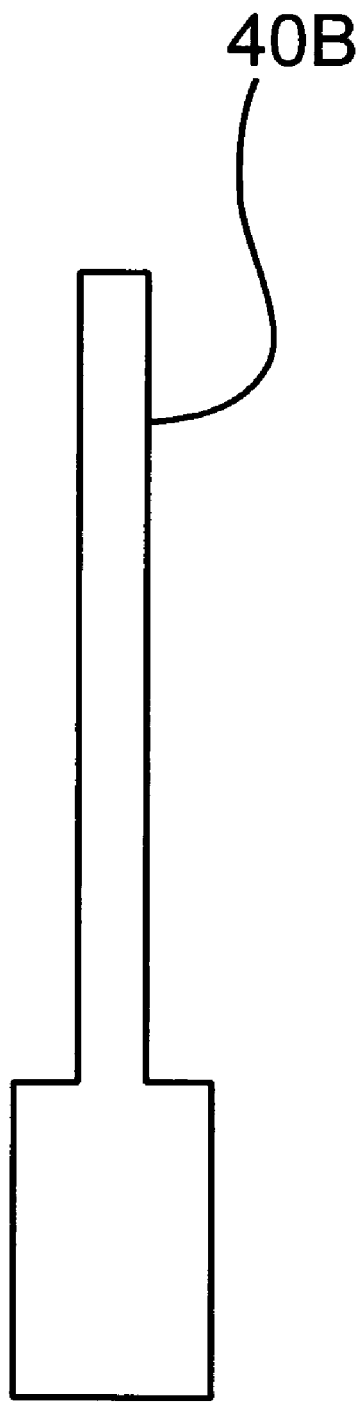
FIG. 7B is a front, elevational view of the indicator device of FIG. 7A.

FIGS. 7A and 7B illustrate a liquid level indicator device 40B which is wholly formed of buoyant material such as wood. The liquid level indicator device 40B may be of integral construction, i.e. cut from one piece of wood, or be comprised of a plurality of parts glued or otherwise secured together.

The invention claimed is:

1. In combination:

liquid drain apparatus for draining liquid from a surface, said liquid drain apparatus including a conduit having an upper open end for receiving said liquid and a lower end, a bottom wall partially extending across said lower end and defining an opening at said lower end for discharging liquid from said conduit, a partition having an upper partition end extending upwardly from said bottom wall and cooperable with said conduit and said bottom wall to form an open topped trough within said conduit, and a baffle within said conduit having a baffle lower distal end located in said trough above said bottom wall, said conduit, said baffle and said partition operable to form a liquid seal to prevent gas from passing through said conduit when liquid in said trough is of sufficient depth to engage said baffle lower distal end; and a buoyant liquid level indicator device within said conduit having an upper indicator device end and a lower indicator device end, said lower indicator device end positioned in said trough, said buoyant liquid level indicator device operable to float and move upwardly within said conduit only when a liquid seal is formed by said liquid drain apparatus.

2. The combination according to claim 1 wherein said liquid level indicator device is elongated and wherein said conduit has a length longer than the length of said liquid level indicator device.

3. The combination according to claim 2 wherein said upper indicator device end projects upwardly from the conduit upper open end when a liquid seal is formed by said liquid drain apparatus and is disposed below the conduit upper open end when a liquid seal is not formed by said liquid drain apparatus.

4. The combination according to claim 1 additionally comprising guide structure operatively associated with said liquid drain apparatus and said liquid level indicator device for maintaining said liquid level indicator device in a substantially vertical orientation in said conduit.

5. The combination according to claim 4 wherein said guide structure comprises a grating positioned at or adjacent to said conduit upper open end, said grating defining a grating opening slidably receiving said liquid level indicator device.

6. The combination according to claim 4 wherein said guide structure comprises a holder at least partially positioned within said conduit and defining a holder opening slidably receiving said liquid level indicator device.

7. The combination according to claim 1 wherein said liquid level indicator device includes a flotation member and an elongated indicator member attached to and extending upwardly from said flotation member.

8. The combination according to claim 7 wherein said flotation member is substantially wholly formed of buoyant material.

9. The combination according to claim 8 wherein said buoyant material is cork.

10. The combination according to claim 7 wherein said flotation member comprises a closed, hollow flotation chamber.

11. The combination according to claim 10 wherein said flotation chamber and said elongated member are of integral construction.

12. The combination according to claim 11 wherein said flotation chamber and said elongated member are integrally formed of plastic.

13. In combination:

liquid drain apparatus for draining liquid from a surface, said liquid drain apparatus including a conduit having an upper open end for receiving said liquid and a lower end for discharging the liquid and defining a trough in said conduit for containing liquid to form a liquid seal to prevent gas from passing through said conduit when liquid in said trough is of sufficient predetermined depth; and a buoyant liquid level indicator device within said conduit having an upper indicator device end and a lower indicator device end, said lower indicator device end positioned in said trough, said buoyant liquid level indicator device operable to float and move upwardly within said conduit only when a liquid seal is formed by said liquid drain apparatus.

14. The combination according to claim 13 wherein said liquid level indicator device is elongated and wherein said conduit has a length longer than the length of said liquid level indicator device.

15. The combination according to claim 14 wherein said upper indicator device end projects upwardly from the conduit upper open end when a liquid seal is formed by said liquid drain apparatus and is disposed below the conduit upper open end when a liquid seal is not formed by said liquid drain apparatus.

* * * * *